US009970635B2

(12) United States Patent
Rood

(10) Patent No.: US 9,970,635 B2
(45) Date of Patent: May 15, 2018

(54) PORTABLE PATH LIGHT SYSTEM AND METHOD

(71) Applicant: John Daniel Rood, Fountain Hills, AZ (US)

(72) Inventor: John Daniel Rood, Fountain Hills, AZ (US)

( * ) Notice: Subject to any disclaimer, the term of this patent is extended or adjusted under 35 U.S.C. 154(b) by 151 days.

(21) Appl. No.: 14/880,263

(22) Filed: Oct. 11, 2015

(65) Prior Publication Data

US 2016/0201885 A1 Jul. 14, 2016

Related U.S. Application Data

(63) Continuation-in-part of application No. 29/524,446, filed on Apr. 20, 2015, now Pat. No. Des. 781,495.

(60) Provisional application No. 62/102,799, filed on Jan. 13, 2015.

(51) Int. Cl.

| | |
|---|---|
| ***F21L 4/00*** | (2006.01) |
| ***F21V 21/06*** | (2006.01) |
| ***F21L 4/08*** | (2006.01) |

(52) U.S. Cl.

CPC ..... *F21V 21/06* (2013.01); *F21L 4/08* (2013.01)

(58) Field of Classification Search

CPC ..... F21V 21/06; F21V 21/0824; F21S 9/037; F21S 9/03; F21S 9/035; F21S 8/081; F21L 15/06; A47G 33/1226; A47G 2033/124; E04H 12/2253; E04H 12/2269; F16M 2200/08

USPC ..... 362/183, 431, 414; 403/351, 243, 365, 403/369, 390; 248/523, 524

See application file for complete search history.

(56) References Cited

U.S. PATENT DOCUMENTS

| | | | | | |
|---|---|---|---|---|---|
| 3,302,909 | A * | 2/1967 | Glassman | A47G 33/12 | 248/524 |
| 4,961,668 | A * | 10/1990 | Trautmann | B65G 39/09 | 403/351 |
| 5,462,381 | A * | 10/1995 | DeWachter | F16C 33/20 | 384/300 |
| 5,562,377 | A * | 10/1996 | Giannuzzi | F16C 17/10 | 405/259.5 |
| 6,082,877 | A * | 7/2000 | Hughes | F21S 6/005 | 362/152 |
| 7,597,304 | B1 * | 10/2009 | Gray | A47G 33/12 | 248/172 |
| 8,782,978 | B1 * | 7/2014 | Frenette | E02D 27/42 | 248/519 |
| 9,115,856 | B1 * | 8/2015 | Robinson | F21L 4/08 | |
| 2003/0081406 | A1 * | 5/2003 | Lin | F21S 8/081 | 362/96 |
| 2003/0121223 | A1 * | 7/2003 | Riker | E04H 12/2269 | 52/296 |
| 2009/0025332 | A1 * | 1/2009 | Richards | E04H 12/2269 | 52/704 |

(Continued)

*Primary Examiner* — William N Harris

(74) *Attorney, Agent, or Firm* — Bycer Law, PLC; Matthew L. Bycer

(57) ABSTRACT

A portable path light system including a stabilizing base collar to provide downward pressure and torsional stabilization. The collar is affixed to the poll by one or more, preferably tapered wedging shims. Shims may include flanges to provide for mating with the collar and/or support of the system. Nesting shims can help size, fit, and further support the system. Shims may be rotated to provide a more complete mating with collar.

9 Claims, 12 Drawing Sheets

(56) References Cited

U.S. PATENT DOCUMENTS

| | | | | |
|---|---|---|---|---|
| 2013/0163236 | A1* | 6/2013 | Steele | F21V 21/00<br>362/190 |
| 2015/0211720 | A1* | 7/2015 | Toner | F21S 9/032<br>362/183 |

* cited by examiner

PORTABLE PATH LIGHT SYSTEM AND METHOD

CLAIM OF PRIORITY

The present application is related to and claims priority from prior provisional application Ser. No. 62/102,799, filed Jan. 13, 2015, and prior fried design patent application Ser. No. 29/524,446, filed Apr. 20, 2015 which applications are herein incorporated by reference.

FIELD OF THE INVENTION

The present invention relates to outdoor lighting systems. More particularly, the present invention relates to portable solar lighting systems.

BACKGROUND OF THE INVENTION

Solar pathway lights are a fairly new concept. Before solar path lights, all path lights were wired for electricity, or powered by short term batteries. Being wired, pathway lighting systems were fixed in locations and wires were hidden in the ground—effectively preventing the portability of the lights. Often, an in-ground stake was necessary and beneficial for the permanent installations. Large battery operated path lights were cumbersome and heavy, and therefore often hard-installed in a single location. Little progress has been made to improve the portability of stationary, stake-mounted pathway lights.

Because solar lighting is constantly improving and growing in popularity, the need for a more updated, solid, and portable mounting solution, is greater than ever.

Until now, solar pathway lighting systems were typically mounted on the ground or on a surface requiring a stake that is driven into grass or dirt. Once the stake is secure in the ground, the light post may be fitted over the top of the stake, then the light head is fitted to the top of the post. This retrofit installation procedure limits the use of typical path lighting systems to yard/dirt locations, available for the stake to be secured. Furthermore, this stake mounting system is almost often flimsy, and/or may be installed crooked, because the stake rarely goes into the ground perfectly straight. When mounted, on a paved surface, various adhesives and concrete fixtures are typically used.

It is therefore an object of the present invention to provide a portable solar powered lighting display.

It is a further object of the present invention to provide a base and securing system to support, a portable solar lighting system.

It is yet another object of the present invention to provide a kit for modification of a vertical pole supported light system for portable use.

It is a still further object of the present invention to provide a method for installation and removal, and replacement of a solar-powered pathway lighting system.

SUMMARY OF THE INVENTION

The present invention includes a portable solar light system. The system includes a solar cell situated at the top of a support pole and a collar at its base. The system may include an interior power source, or battery, to power a light, otherwise solar cells can be mounted on the exterior surface, preferably the top, to collect, transform and transfer energy. Battery can take the form of a conventional battery, as known in the art, of a capacitor, or any other means of storing electrical, heat, or other form of energy. A support pole connects and supports the top and collar. The collar has sufficient weight to withstand torsional pressures posed by the support pole, i.e. wind, manual pressures, weight of system, etc. The collar is preferably fitted around at least a portion, preferably at the bottom, of the support pole. The collar may have a hollow cavity, or center hole, for engaging a portion of the pole. A shim may be attached to an outer surface, preferably at the lower end, of the pole so as to promote coupling between the collar and the pole. The shim interior surface may be coupled to the support pole outer surface. In one embodiment a second shim fits over the first shim, whereby the first shim mates with the pole and the second shim males with the collar. The shims can be nested on top of one another, or be oriented around the longitudinal axis of the pole in parallel or off-angle, such as 45 degree or 90 degrees.

Shims may include a flange, curved or straight, at the bottom of the shim. The flange forms a corner whereby the mating cavity fits into the corner. The flange may vertically support the base. The flange may prevent the pole from being lifted out of the base and system, and otherwise secure the pole in place.

The shim may be tapered towards the top, to allow easier placement within cavity (after shim is applied to pole). When nested, the tapered shim(s) form(s) a wedge system to further secure the pole to the collar.

An adhesive may be used to connect the shims to one another, to the pole, and/or to the cavity of the base. Preferably, the adhesive includes a two-sided adhesive tape, preferably at least 20-lb rated, or otherwise as is known and/or preferred in the art. In one embodiment, a stake may be affixed to the bottom of the vertical pole to provide additional horizontal and/or torsional support (to keep the system from falling over).

The collar may directly meet with a ground surface. In such case, a recessed ring may situate around the cavity at the bottom of the base. The bottom of the base may include a porous surface to allow for adherence to a surface, which as with cement. The bottom surface may include pads, such as felt pads, to support the base on the ground.

The present invention also includes a method for stabilizing a solar powered lighting system. A shim, or shims, are affixed to the bottom outside surface of the pole. The pole is fitted through the cavity of a base. Finally, a light, preferably with power source such as at least one solar cell, is affixed atop a pole. Then the portable system is placed upon a supporting surface.

In one alternative embodiment, a stake can be affixed to the pole before or alter the system is completed. The stake further secured the light system to the ground surface. A second shim may be piggy-backed atop the first shim to expand the diameter of the pole and shim system to better mate with the collar bore. A third, fourth, or more shims may be piggy-backed successively atop the initial shim to provide a tighter fit, wedge system, or the like.

BRIEF DESCRIPTION OF THE DRAWINGS

The present invention can be further illustrated through a description of certain embodiments.

DETAILED DESCRIPTION OF PREFERRED EMBODIMENTS

Figure 1:
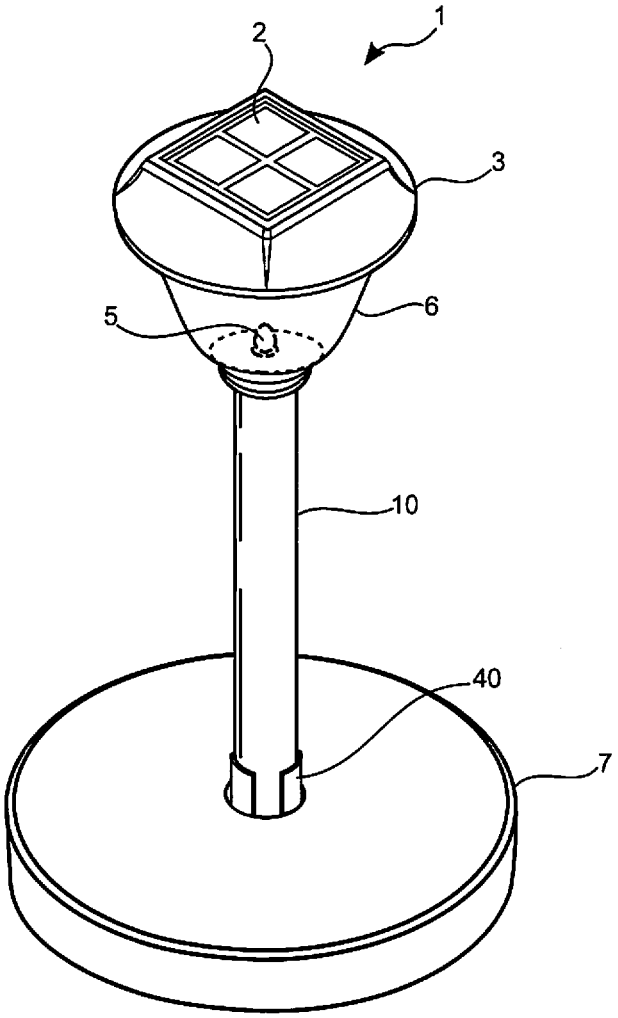
FIG. 1 demonstrates a perspective view of an embodiment of the present invention.

The present invention includes a Portable Path Light System (PPLS) for solar type pathway lights. PPLS changes the means by which the light post is supported. The PPLS can be used with or without a grounding stake. PPLS changes the means by which the light post is supported. PPLS can eliminate the need for a stake by adding a heavy, more secure, base to the bottom of a light post. PPLS is preferably comprised of heavy material such as concrete, iron, or the like, with a hole through the center to accommodate a support pole therein. This center hole acts as, and makes the base, a "collar" and is used to hold or lock the post in place. With a heavy base secured to the light post, the once stationary "staked light" becomes a portable light. PPLS no longer requires a stake (and soft/dirt ground support) for mounting. PPLS can be used on stairways, tables, walls, sidewalks, . . . anywhere a light is needed, PPLS can be positioned in a location to collect (and store) solar light, or can be placed in a location to collect power, and displayed (once charged) into a location requiring light. For instance, the light can be charged outside during the day, and in the evening brought indoors and placed on a dining table to provide light.

The present invention also includes a PPLS method to secure a solar path, lights upright and level, by adding a locking collar, heavy base to the light post. In an alternative embodiment, the stake (that is sold with stake lights) can be used with the PPLS to give added support to solar path lights when mounted or staked in the ground. When the stake is used, the collar may be tightened, or clamped, to the post around the stake for added stability.

In one embodiment of the present, invention a collar (the heavy base) includes a hollow bore hole to allow the pole to pass and rest therein. The support pole is typically set vertically, or perpendicular from the ground or support surface, but may be oriented anywhere from flat (just over zero degrees) to vertical (ninety degrees). Depending on the structure of the pole (be it cylindrical, rectangular, etc.) the bore hole can be complimentarily shaped to accommodate. Shims may be used to lock the post in place into the collar. Shims may be adapted to mate with the pole and/or the collar or base. The collar may be fixed bore in the weighted base.

A collar suitable for the present invention may include ring or band used to hold, something (such as pipe or a part of a machine) in place. The collar may be decorative and made of heavy material, such as repurposed iron lifting weights. The collar may also include an ornamental feature, such as that one shown in U.S. Design patent application No. 29/524,446, or otherwise ornamented, shaped or colored, etc, as is known in the art or industry.

The underside of the weighted base may be textured and/or porous, so that the base bottom can be adhered (e.g. by glue or cement) to other porous surfaces such as concrete or wood or spacer. A felt pad or tabs can be affixed to the underside of the weighted base so as to prevent scratching when the PPLS is positioned or shifted on a surface and thus will not scratch fragile surfaces.

A shim suitable for an embodiment of the present invention may be a thin and may be tapered or wedged piece of material, used to fill small gaps or spaces between objects. Shims are typically used in order to support, adjust for better fit, or provide a level surface. Shims may also be used as spacers to fill gaps between parts subject to wear. The shims may include two-sided, preferably 20-lb rated, exterior grade mounting tape on the inside that secures the shim to the light post. The shim adhesive may be only on the lower half of the inside of the shim so that the upper, tapered, half can be pressed into the collar more easily. The shim adhesive tape is preferably double-sided. The shim may be tapered at the top so that the collar gets tighter around the post as it is pressed down onto the shim(s). The shim may be thinner at the top and thicker at the bottom. When the term "affixed" is use din the present invention, it refers to placing items in direct contact with one another, or with an adhesive placed between them, whereby either there is direct contact, or there is adhesive and/or space between the two, but no other item placed between two affixed structures.

In one preferred embodiment the shim may have a flange at the bottom. The shim may prevent the collar from slipping off, or through of the post. The shim or shims may be secured to the post to fill the space between the collar and the post (i.e. pole), thereby making a tight fit between the two. When the shim is tapered, the downward force of the weighted base can lock the pole in place. The tape may keep the post from slipping between the shims. The shim's flange keeps the collar from falling off the shims.

Figure 11:
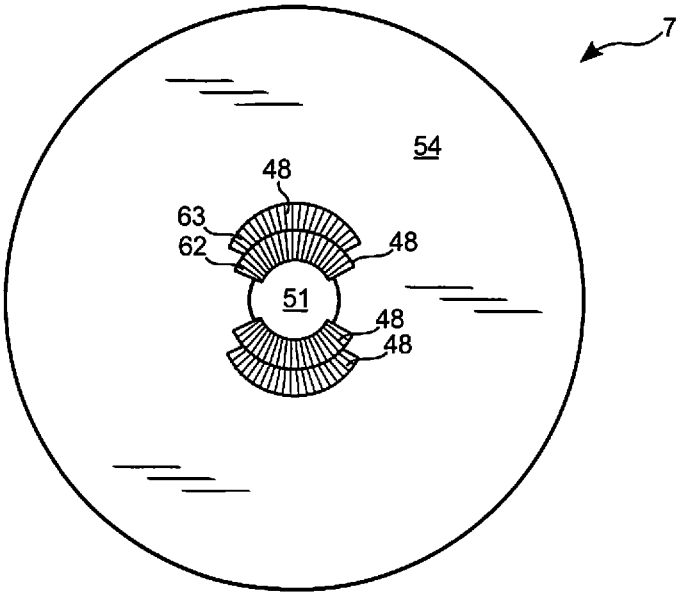
FIG. 11 demonstrates a bottom view of an alternative embodiment of the present invention.
Figure 13:
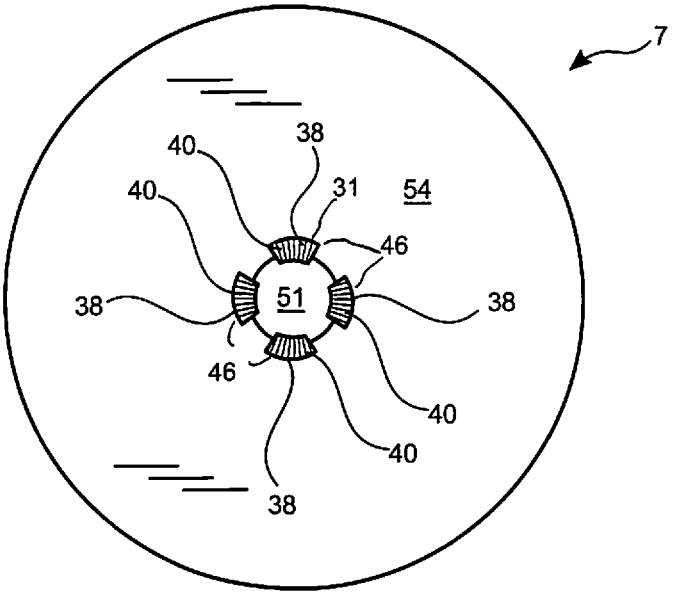
FIG. 13 demonstrates a bottom view of an embodiment of the present invention.
Figure 14:
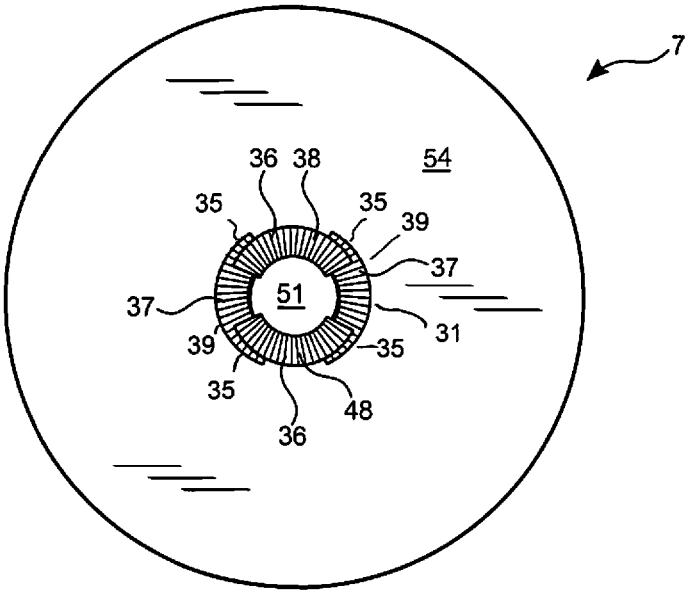
FIG. 14 demonstrates a bottom view of an embodiment of the present invention.

Multiple shims may be used to make various sized posts fit within the fixed sized collar. Multiple shims can be piggy-backed onto other shim or shims using the tape mounted to the initial shim and/or between shims. Piggy-backing the shims expands the diameter of the post+shims so the collar can lock more tightly around the post. The shims can also overlap each other in order to expand the diameter of the post. Shims may also be piggy-hacked in an orientation to turn around the side of the pole (as shown in FIG. 11), for instance, it is preferred that the shims piggy-back with a 90-degree rotation orientation (as shown in FIGS. 13 and 14).

The shims can also be placed on square-shaped posts, thus allowing square or other shaped posts to fit inside the round collar (signs for stores and individual use like garage sales, etc). The shim does not have to be curved, but preferably mates with the contour of the support pole. Similarly, the center hole should complement the shape of the support pole. The shim may be flat so that two or four shims may be placed onto a flat surface, such as a square post, or possibly a flat post, or wall. The shims can be piggy-backed numerous times, if not only twice, but three- or four-times deep, given its nesting shape geometry. A shim may include a tapered wedge. The shim may also include a flange and tape for affixing to the pole.

As is known in the art, solar light posts and stakes are typically either metal or plastic. The shim system of the present invention system can be used with both. PPLS make solar path lights much more versatile, level, and stable. The lights can be moved into the sunny spot for charging the batteries during the day. They can also be used indoors for functional use, and brought back outside to charge. PPLS can be moved Into an area at night that needs more light.

PPLS protects the light from being damaged in several ways. The base adds a rigid, solid center-of-gravity to prevent the post from being knocked off the stake, pushed over, or bent/unleveled. The PPLS can be brought indoors in bad weather or moved out of the way during lawn service or lawn watering, or for various alternative uses of the space. Multiple PPLS can be arranged in any fashion suited for the occasion. PPLS allows lights to be re-positioned for seasonality and sunlight patterns. The lights can be placed on any flat surface where electrical wiring is not available.

Referring now to the figures, FIG. 1 demonstrates a perspective view of an embodiment of the present invention. PPLS light system 1 includes a power source 2, such as a solar panel, or other power collection/storage device, a top 3 section with a casing 6 to house a light source 5 (such as a light bulb, preferably an LED, or mirror). To top 3 is supported by support pole 10. Support pole 10 is placed into base 7, and preferably secured with at least one shim 40. A single shim can be used on one side, or a pair of shims can be used, as shown. Additional shims or securing devices, including tape, can be used.

Figure 2:
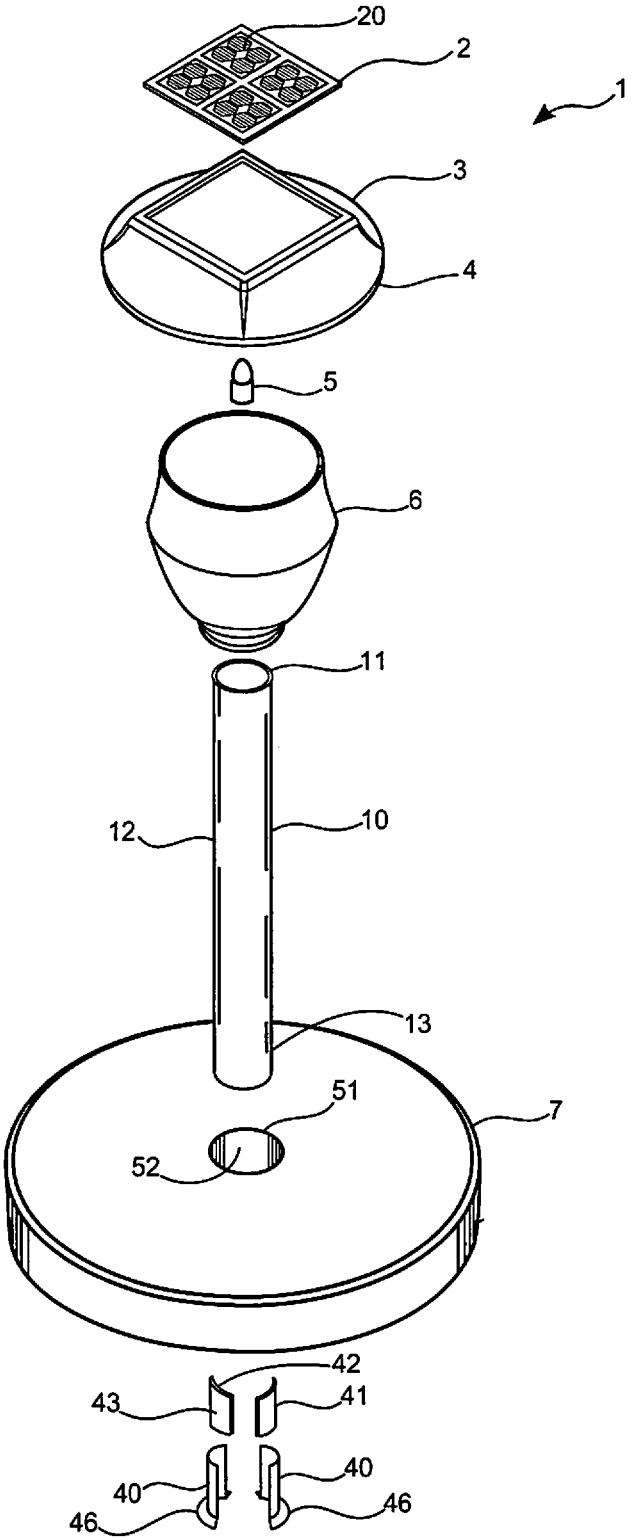
FIG. 2 demonstrates an exploded view of an embodiment of the present invention.

FIG. 2 demonstrates an exploded version of the embodiment shown in FIG. 1. Powers source 2 includes solar cells 20, titled atop top 3, top 3 includes cap shield 4 and mates with cover 6 (housing light source 5). Top 3 mates with support pole 10 at pole top 11 above shaft 12. Support pole bottom 13 is fitted through complimentary cavity 51 in base 7. Preferably support pole is coupled to cavity interior surface 52 via shims 40 and tape 41. Tape interior surface 42 may mate directly with support pole while tape exterior surface 43 may be used to attach shim 40. Shim 40 preferably include flange 46 at the bottom of shim 40. Flange 46 serves to set support pole in place and allows weight of base 7 to exert downward pressure indirectly onto pole 10.

Figure 3:
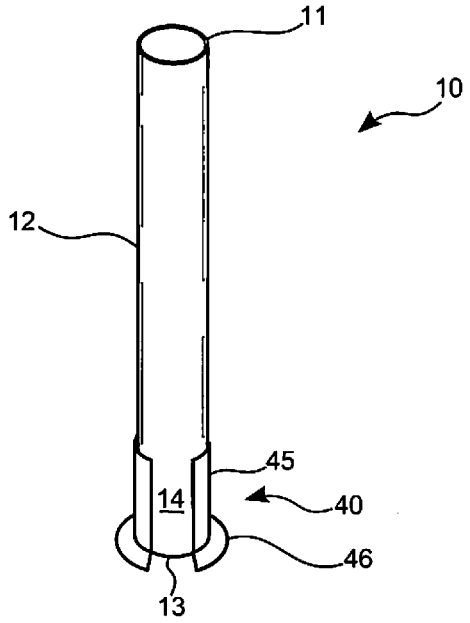
FIG. 3 demonstrates a close-up partial view of components of an embodiment of the present invention.

FIG. 3 demonstrates the pole with a pair of shims of the present invention in isolation. Pole 10 includes shaft 12 between, pole top 11 and pole bottom 13. Shims 40 fit on pole 10 lower shaft surface 14. When shim 40 is attached to pole 10, shim exterior surface 45 is exposed, preferably for mating with the interior of cavity on weighted base (not shown). Shim flange 46 extends outwardly from pole bottom 13, or below. Flange 46 can secure the pole form lifting out of the base, and/or directly contact the ground surface.

Figure 4:
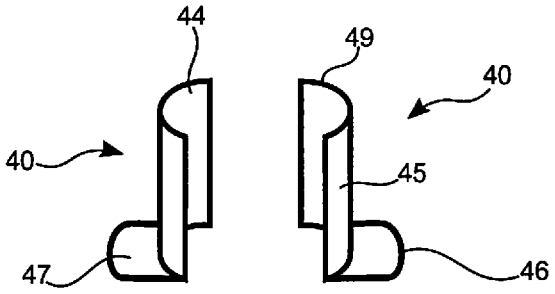
FIG. 4 demonstrates a perspective partial view of components of an embodiment of the present invention.

FIG. 4 demonstrates an embodiment of a single pair of shims 40 in isolation. Shim 40 includes shim top 49, interior surface 44 and exterior surface 45. Flange 46 includes flange top surface 47. Flange top surface mates with the bottom of base (not shown). Flange 46 top surface 47 prevent base from falling below support pole and secures the system together with gravity.

Figure 5:
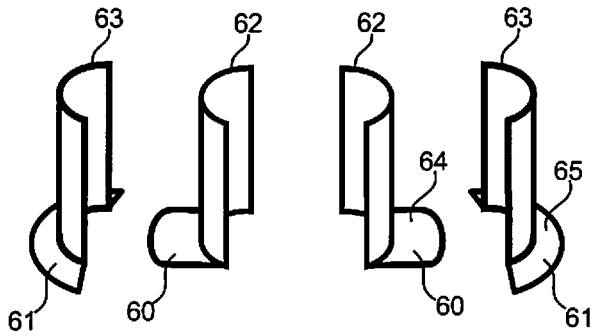
FIG. 5 demonstrates a perspective partial view of components of an alternative embodiment of the present invention.

FIG. 5 demonstrates two pairs of nested shim (in exploded view) in isolation. Shims may be identical when nested, or have alternative flange systems (as shown). Interior shims 62 may include a short flange 60 with flat side 64, while exterior shims 63 may include large flanges 61 with curved flange 65. Various orientations, grouping of flat, rounded, curved and other geometric shapes for the flanges are contemplated.

Figure 6:
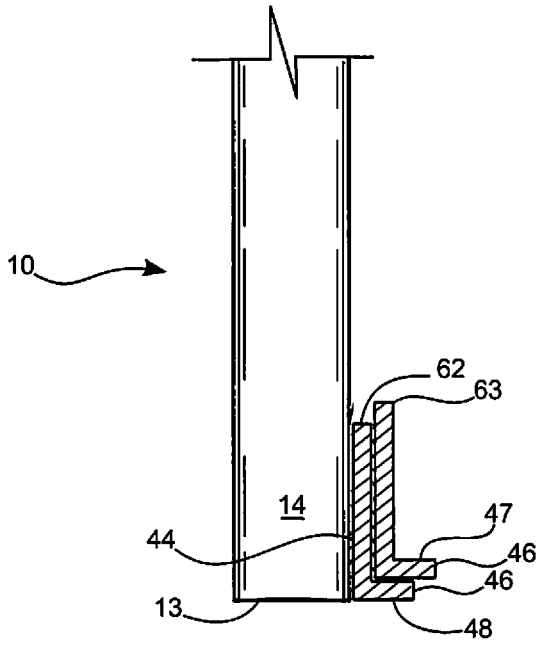
FIG. 6 demonstrates a side view of a lower portion, in partial cross-section, of an embodiment of the present invention.

FIG. 6 demonstrates a partial cross-section of shims 62 and 63 applied to support pole 10 and pole lower surface 14 along pole bottom 13. Interior shim 62 includes interior surface 44 to mate with pole directly, or via tape, or other adhesive (not shown). Interior shim includes flange 46 with flange bottom 48 to mate with the ground, other surface, or in case of a strong shim, may be float above the ground. Flange 46 may include flange to 47 to vertically support exterior shim 63.

Figure 7:
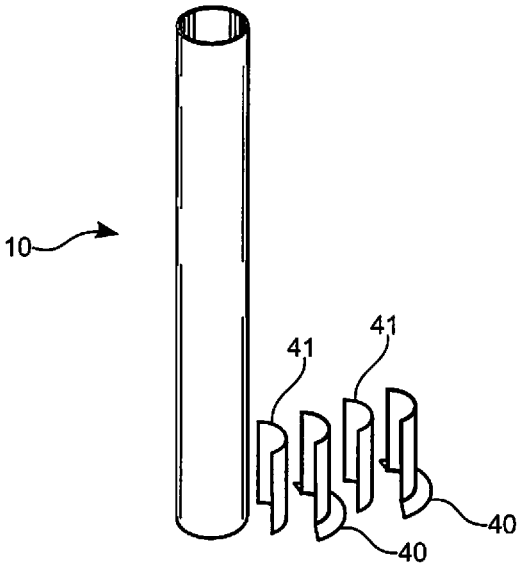
FIG. 7 demonstrates an exploded perspective view of a support pole and shims of an embodiment of the present invention.

FIG. 7 demonstrates a partial view of an embodiment of the present invention with two shims and tape adhesive. One, or more, shims 40 may be applied, to pole 10 via tape 41. When nested, shims 40 may be adhered to one another via tape or may be adhered to one another via force of the weighted base. Shims may also include surface texture (e.g. rippled, interlocking grooves, rough surface, etc.) to allow for better adherence to the pole, weighted base, and/or other shims.

Figure 8:
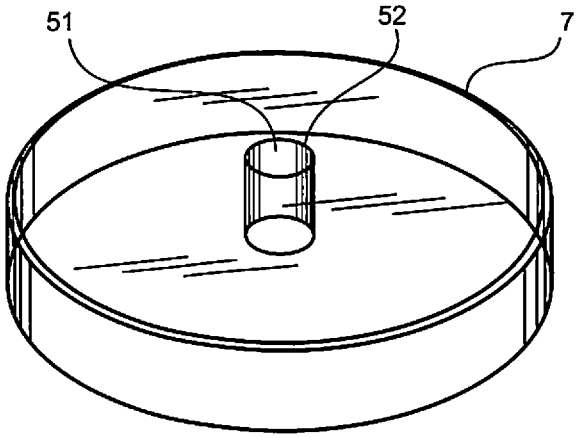
FIG. 8 demonstrates a clear perspective view of the base of an embodiment of the present invention.

FIG. 8 demonstrates a simple weighted base of an embodiment of the present invention. Base 7 may be any solid structure with a substantial weight to prevent the PPLS from failing over, in light wind conditions, or even heavy weather. Base 7 includes a cavity 51, through which a support pole can fit. Cavity interior surface 52 can mate directly with, the pole, or an adhesive, or directly to a shim.

Figure 9:
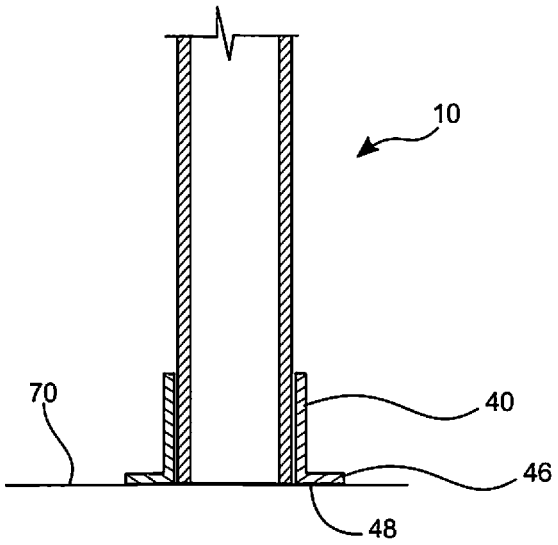
FIG. 9 demonstrates a cross-section of the lower end of a support pole with shims of an embodiment of the present invention.
Figure 10:
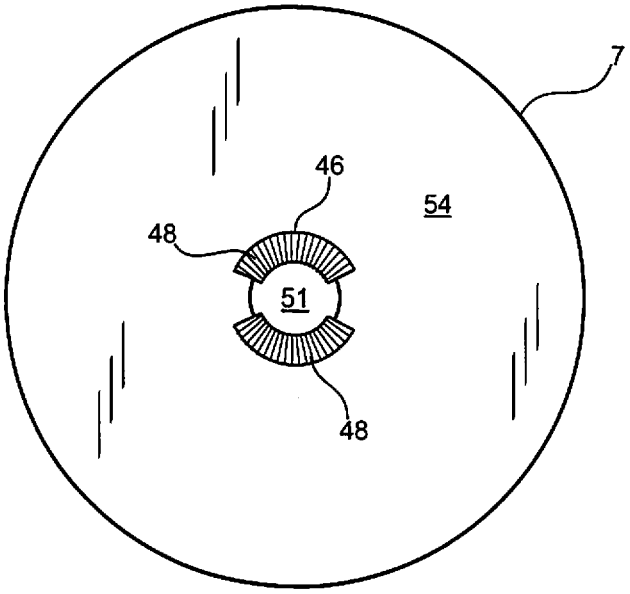
FIG. 10 demonstrates a bottom view of an embodiment without base of the present invention.

FIG. 9 shows a cross-section of the pole bottom with a shim attached. Pole 10 mates with shim 40. Shim 40 includes flange 46 with flange bottom 48 which can preferably mate with ground surface 70.

FIGS. 10-14 show various embodiments of the present invention from the bottom view. One (not shown) or a pair or many pairs of shims may be used to secure the pole to base 7 through cavity 51. Flanges 46 should extend beyond cavity 51, below base 7 and base bottom surface 54. Flange bottom 48 forms the lowest portion of the PPLS. Multiple nested shims may be used. An exterior shim 63 fits outside other shims. Interior shim 62 preferably mates with pole (not shown) and is exposed to cavity 51. In one embodiment, second interior shim 66 fits between the interior and exterior shims. Multiple interior shims may be used. The number of shims is preferably suited to allow pole to match properly with cavity size. When the pole is small in diameter compared to cavity, multiple shims should be used.

Figure 12:
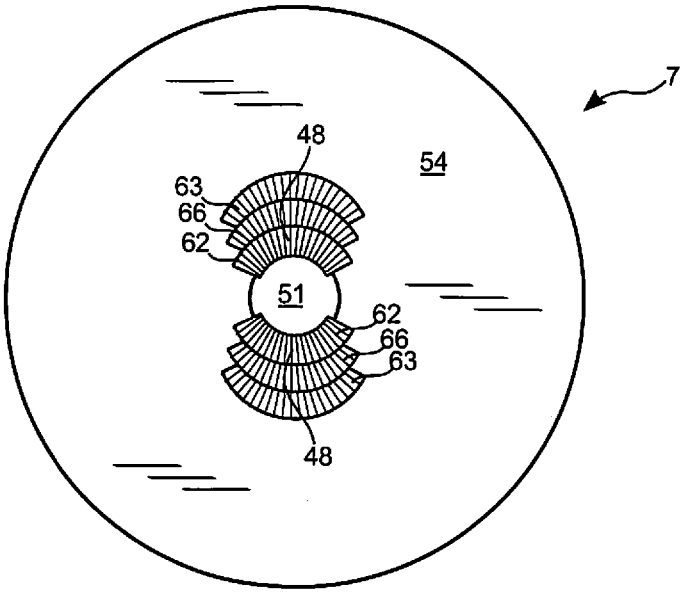
FIG. 12 demonstrates bottom view of an alternative embodiment of the present invention.

FIG. 11 demonstrates a doubling of nested shims, with a set of the pair of doubled shims on either side. FIG. 12 demonstrates a tripling of nest shims.

In an embodiment of the present invention, rounded shim flange 30 may include arc length of less than ninety degrees as shown in FIG. 13. Flange arc length 31 should be at least thirty degrees, and is preferably at least ninety to one hundred-fifty degrees. Arc length may be as wide as 360 degrees constituting a snap-on collar for the pole (not shown). It is contemplated that the width of the shim is complementary to the flange, such as meeting the same arc length. Alternatively, shim may be wider to provide additional surface contact with weight and/or pole. Alternatively, shim may be less wide that a long arc length flange to provide additional vertical support and/or contact with the collar bottom, (recessed) cavity, stake, or ground. As seen in FIG. 1.4, when shim flange arc length 31 is longer than ninety degrees, and shims are nested, they may be rotated and overlapped to provide more security and stability. By reinforcing the shims, the vertical support is enhanced. Bottom shim 38 couples under top shim 39. Bottom, flange 36 underlies a portion of top flange 37 at overlapping points 35. It is contemplated that only bottom flange 36 will be available to mate with the ground and or stake, while top flange 37 mated with weighted base. As particularly shown in FIGS. 13 and 14, shims may nest in a rotating fashion, and do not necessarily require direct placement. They may be rotated ninety degrees to provide additional coverage via flanges 46 (as shown in FIG. 13), or to overlap and cover the entire diameter of the cavity 51 (as shown in FIG. 14). Alternative embodiments are envisioned with, the details provided, above. For instance three shims can be used around the pole (or on three sides of a rectangular pole) wherein each flange is no greater than one hundred-twenty degrees and the shims are rotated one hundred-twenty degrees, etc. When flat shims are placed on a flat surface of a rectangular pole, the flange may be straight or curved to accommodate the weighted base, or other portion of the invention or the ground.

Figure 15:
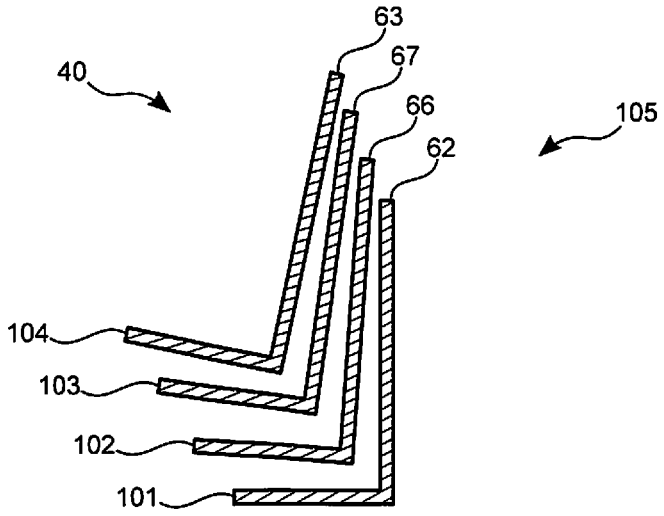
FIG. 15 demonstrates a side cross-sectional view of nested shims of an embodiment the present invention.
Figure 16:
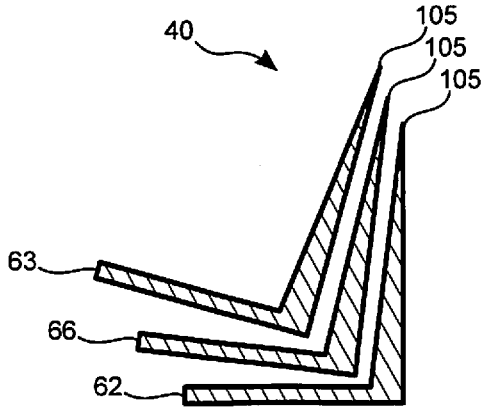
FIG. 16 demonstrates a side cross-sectional view of nested shims of an embodiment the present invention.

FIGS. 15 and 16 demonstrate a side-view cross-section of the nested shims of an embodiment of the present invention. Shims can be nested four-deep or four-high as shown in the figures. Interior shim 62 mates with pole (not shown), which is then nested by second interior shim 66, then third interior shim 67, and finally fourth Interior shim or exterior shim 63, which presumably mates with base (not shown. When nested, first shim 101 sits under second shim 102, which in turn sits under third shim 103, which in turn sits under fourth shim 104. First shim 101 may be the only shim to contact the pole and, if exposed, the ground, stake, etc. Fourth, shim 104 contacts the interior of hollow bore, not shown. Tops 105 of all shims may also meet and contact the pole and/or adhesives. Adhesives may be fitted between one or many of the shims (not shown). When shims are wedged, as shown in FIG. 16, all shim tops may touch pole (not shown). Additionally, as seen in both FIGS. 15 and 16, as the shims are nested, they may tend to flare outward, such that the second through fourth shims 102, 103, and 104, are angled outward. This provides additional contact with the pole, and/or provides for better grip on the edge of the hollow cavity (not shown), or provides additional wedging to secure weighted base in place with pole. Flaring between each shim can be limited, as shown in FIG. 15, to less than fifteen degrees, or exaggerates with wedged shims (as shown in FIG. 16) to as great as thirty to forty-five degrees. Nested shim flaring can reach as high as ninety degrees.

Figure 17:
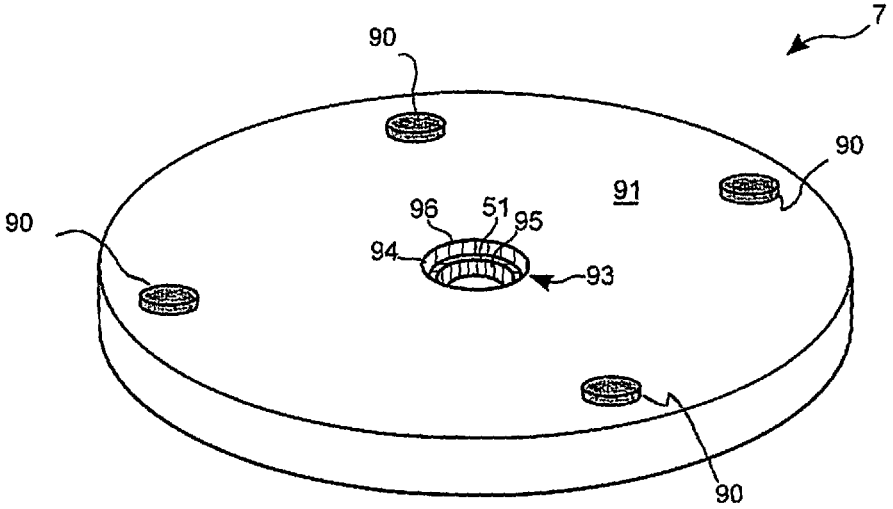
FIG. 17 demonstrates a flipped underside view of the bottom of an embodiment of the present invention.

FIG. 17 demonstrates an upside-down view of the bottom of the weighted base of an embodiment of the present invention. Base bottom 91 may include pads 90 to allow base to be put on a delicate surface. Base 7 includes cavity or bore hole 51 with interior edge 94. Base 7 may include a bottom 91 with a recess 93. Recess 93 includes bottom edge 95 for mating with a shim flange (not shown). Shim flange should not be wider than base recess edge 96. In this embodiment, shim flange can be elevated above the ground level, while shims lock pole in place, preferably above the ground level.

Figure 18:
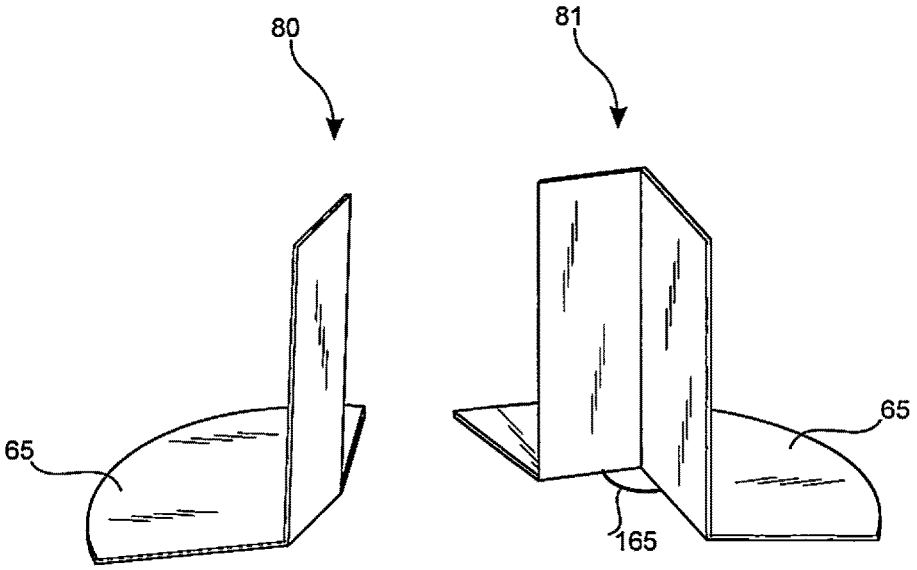
FIG. 18 demonstrates alternative shims of an embodiment of the present invention.

As seen in two alternative shape embodiments of shims in FIG. 18, flat edge shims may be useful with a flat edges pole known in the art (not shown). Single flat edge shim 80 can make with a single flat surface of pole, and possibly weighted base. Double flat edge shim 81 can mate with two surfaces and a corner of a multiple flat edged pole and/or base. For rectangular poles, angle 165 should be approximately ninety degrees, but may expand as high as one hundred degrees, to accommodate placement and optional adhesive. Flanges for flat shims may be flat, or curved flanges 65 as shown.

Figure 19:
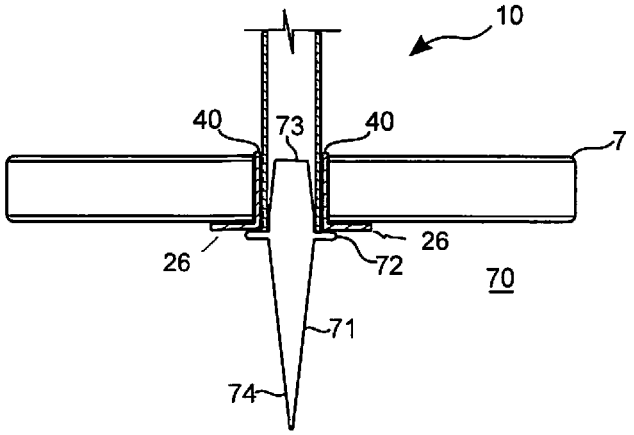
FIG. 19 demonstrates a side cross-sectional view of the lower portion of an alternative embodiment of the present invention.
Figure 20:
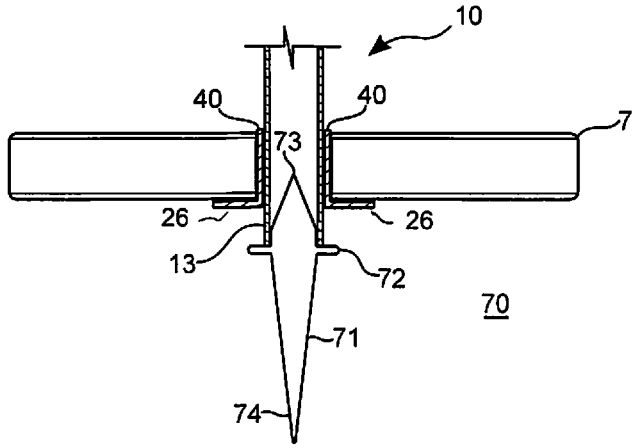
FIG. 20 demonstrates a side cross-sectional view of the lower portion of an alternative embodiment of the present invention.

FIGS. 19 and 20 demonstrate two alternative cross-sections of the lower end of an embodiment of the present invention when including a stake. As shown in FIG. 19, pole 10 mates with shim 40, which in turn mates with inside of weighted base 7. Shims 40 may also mate with stake 71 at flange 46 whereby stake flange 72 meets with the bottom of shim flange 26. Stake head 73 may be inserted within a hollow pole 10 and spike 74 reaching down into ground 70. In an alternative embodiment shown in FIG. 20, pole bottom 13 may extend below shim 40 to mate with stake flange 72.

I claim:

1. A portable solar light system comprising of:

a. at least one solar cell supplying power to at least one battery;

b. at least one light source powered by either said at least one solar cell or said at least one battery;

c. said at least one light source and said at least one solar cell supported atop a support pole, said support pole comprising an outer surface;

d. a collar, having a weight to withstand torsional pressures posed by said support pole, fitted around at least a portion of said support pole, said collar comprising a hollow cavity for encapsulating a portion of said pole there through, said hollow cavity comprising a cavity surface; and e. at least a first shim, said at least first shim comprising an interior surface and an exterior surface; said at least first shim further comprising a flange extending perpendicularly from a bottom of said exterior surface adapted to mate with a surface of said collar, and said at least first shim attached to said outer surface of said pole so as to provide coupling between said collar and said pole;

wherein said at least first shim interior surface is coupled to said support pole outer surface, said system further comprising at least a second shim, said at least second shim comprising an interior surface and an exterior surface, said at least second shim interior surface affixed to said at least first shim exterior surface, and wherein said at least second shim exterior surface is coupled with said cavity surface.

2. The portable solar light system of claim 1, wherein said at least second shim comprises a flange, wherein said at least first shim flange sits atop said at least second shim flange.

3. The portable solar light system of claim 2, wherein said at least second shim is oriented in parallel to the orientation of said at least first shim around said pole so as to overlap with said at least first shim.

4. The portable solar light system of claim 2, wherein said at least second shim is oriented approximately forty-five degrees from the orientation of said at least first shim around said support pole.

5. The portable solar light system of claim 2, wherein said at least second shim is oriented ninety degrees from the orientation of said at least first shim around said support pole.

6. A portable solar light system comprising of:

a. at least one solar cell supplying power to at least one battery;

b. at least one light source powered by either said at least one solar cell or said at least one battery;

c. said at least one light source and said at least one solar cell supported atop a support pole, said support pole comprising an outer surface;

d. a collar, having a weight to withstand torsional pressures posed by said support pole, fitted around at least a portion of said support pole, said collar comprising a hollow cavity for encapsulating a portion of said pole there through, said hollow cavity comprising a cavity surface; and e. at least a first shim, said at least first shim comprising an interior surface and an exterior surface; said at least first shim further comprising a flange extending perpendicularly from a bottom of said exterior surface adapted to mate with a surface of said collar, and said at least first shim attached to said outer surface of said pole so as to provide coupling between said collar and said pole;

wherein said at least first shim interior surface is coupled to said support pole outer surface, said system further comprising at least a second shim, said at least second shim comprising an interior surface and an exterior surface, said at least second shim interior surface affixed to said at least first shim exterior surface, further comprising at least a third shim, said at least third shim comprising an interior surface and an exterior surface, said at least third shim interior surface affixed to said at least second shim exterior surface.

7. The portable solar light system of claim 6, further comprising at least a fourth shim, said at least fourth shim comprising an interior surface and an exterior surface, said at least fourth shim interior surface affixed to said at least third shim exterior surface.

8. A method for stabilizing a solar powered lighting system comprising the steps of:

a. providing a support pole for holding up solar and lighting portions of the system;

b. adhering at least a first shim to the pole surface to provide a mating surface between the pole and the collar;

c. piggy-backing a second shim atop the first shim to expand the diameter of the pole and shim system;

d. placing said support pole, with the at least first shim and a second shim attached, within a bore of a collar;

e. affixing said pole within the collar bore;

f. placing the solar powered lighting system upon a supporting surface.

9. The method for stabilizing a solar powered lighting system of claim 8, wherein said step of piggy-backing the second shim comprises affixing second shim in a 90 degrees rotated orientation from said first shim.

* * * * *